United States Patent [19]

Maier et al.

[11] 3,935,821

[45] Feb. 3, 1976

[54] METHOD OF AND APPARATUS FOR CREELING BOBBINS ON A RING SPINNING MACHINE

[75] Inventors: Helmut Maier; Alois Mayer; Friedrich Kugelmann, all of Augsburg, Germany

[73] Assignee: Augsburger Kammgarn-Spinnerei AG, Augsburg, Germany

[22] Filed: June 25, 1973

[21] Appl. No.: 373,452

[30] Foreign Application Priority Data

June 28, 1972 Switzerland ..... 9673/72

[52] U.S. Cl. ..... 104/89; 57/52; 104/131; 198/177 R

[51] Int. Cl.[2] ..... B61B 3/00

[58] Field of Search ..... 198/177 R; 104/89, 91, 104/93, 131; 57/52, 53, 54

[56] References Cited

UNITED STATES PATENTS

| | | | |
|---|---|---|---|
| 491,151 | 2/1893 | Werner | 104/91 |
| 1,417,528 | 5/1922 | Irish et al. | 104/91 |
| 1,442,360 | 1/1923 | Price et al. | 104/131 |
| 2,927,538 | 3/1960 | Cormier | 104/89 X |
| 2,956,514 | 10/1960 | Bishop | 198/177 R X |
| 3,132,463 | 5/1964 | Glastra et al. | 57/52 |

*Primary Examiner*—James B. Marbert
*Assistant Examiner*—Douglas D. Watts
*Attorney, Agent, or Firm*—Werner W. Kleeman

[57] ABSTRACT

A method, of and apparatus for, creeling bobbins into a working position on a ring spinning machine wherein rails are arranged above the ring spinning machine, these rails extending substantially parallel to the longitudinal axis of the ring spinning machine. The rails accommodate trolleys movable therealong and carrying bobbins placed thereon. Connecting means serve to connect the rails to a rail arrangement leading to the ring spinning machine. In operation, the trolleys are transported onto the rails above the ring spinning machine and the full bobbins are brought into their working position.

25 Claims, 10 Drawing Figures

METHOD OF AND APPARATUS FOR CREELING BOBBINS ON A RING SPINNING MACHINE

BACKGROUND OF THE INVENTION

The present invention relates to a new and improved method of, and apparatus for, creeling bobbins into their working position on ring spinning machines.

This particular art is already acquainted with devices for transporting full bobbins from roving frames to ring spinning machines with the aid of suspended rails. In these state-of-the-art devices, the bobbins are suspended near the roving frames upon trolleys which roll along rails and are transferred to the ring spinning machine. At that location the bobbins are manually removed from the trolleys and suspended in the creel of the ring spinning machine. The empty bobbin tubes removed from the ring spinning machine are suspended on the same trolleys and again transported back to the roving frames. The term "trolley" as employed herein is intended to designate a vehicle which preferably is provided with two rolls and suspended from the rails by means of such rolls and carrying the bobbins.

A shortcoming of such prior art device resides in the fact that the bobbins must be manually removed from the trolleys and then lifted-up to the relatively high location of the creel of the ring spinning machine so as to be suspended thereat. This operation is relatively difficult for the machine operators, especially since most of them are women, and particularly in view of the considerable weight of the bobbins which can amount to as much as four kilograms. Further, this operation must be carried out within the shortest possible time span in order to maintain the downtime of the machine at a minimum.

Equipment is also known in this particular art wherein bobbins doffed from a roving frame and suspended upon a transporting arrangement are taken over by an accumulating device and carried to the ring spinning machines. At the location of each ring spinning machine there is provided a take-off mechanism which moves the bobbins placed in the accumulating device into an intermediate accumulating device, from which location they are then pushed by a pushing mechanism onto supporting pins of a transporting device consisting of an endless link chain. This last-mentioned transporting device is disposed above the creel of the ring spinning machine and extends parallel to such ring spinning machine. The bobbins which are thus transported to the ring spinning machine are manually removed by the ring spinning machine operators or are removed by an additional automatic mechanism and suspended at the holders of the creel.

A drawback of this type of equipment resides in the fact that the same is extremely complex, and furthermore, the bobbins must be again placed into the creel of the ring spinning machine manually or with the aid of an expensive auxiliary mechanism.

SUMMARY OF THE INVENTION

While keeping the foregoing background in mind, it is a primary object of the present invention to provide an improved method of, and apparatus for, creeling bobbins into their working position on a ring spinning machine in a manner which effectively and reliably overcomes the aforementioned drawbacks and limitations of the prior art proposals.

Another and more specific object of the present invention is directed to an improved method of, and apparatus for, exchanging in a most simple and reliable manner the empty bobbin tubes suspended from the creel of the ring spinning machine against full bobbins without incurring the previously discussed disadvantages.

Yet a further significant object of the present invention relates to an improved method of, and apparatus for, reliably, efficiently and positively creeling bobbins into their working position on a ring spinning machine without the need of resorting to complicated manipulations or expensive auxiliary equipment, while keeping the downtime of the machine during such operation to a minimum.

A further significant object of this development aims at the provision of apparatus for creeling bobbins into a working position at ring spinning machines, which apparatus is relatively simple in construction and design, easy to use, extremely reliable in operation, not readily subject to breakdown, and requires a minimum of servicing and maintenance.

Now, in order to implement these and still further objects of the invention, which will become more readily apparent as the description proceeds, the apparatus of this development for creeling bobbins into their working position on a ring spinning machine comprises an arrangement of rails provided above the ring spinning machine, the rails extending substantially parallel to the longitudinal axis of such ring spinning machine and serving to take-up trolleys movable along these rails and carrying bobbins placed thereon. Connecting means serve to operatively connect the rails with a rail arrangement leading to the ring spinning machine.

As already indicated above, the invention is further directed to a method of creeling bobbins into their working position at a ring spinning machine and contemplates moving the trolleys onto the arrangement of rails above the ring spinning machine and thus placing the bobbins into their working position.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
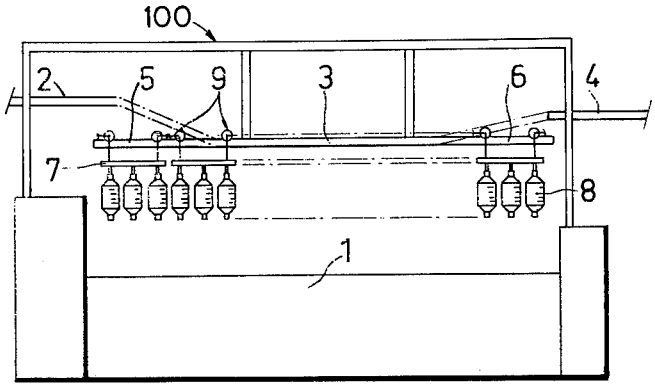
FIG. 1 is a side view of a ring spinning machine provided with a bobbin creeling apparatus according to the teachings of the invention and depicting the bobbins in their working position above the schematically illustrated ring spinning machine.
Figure 2:
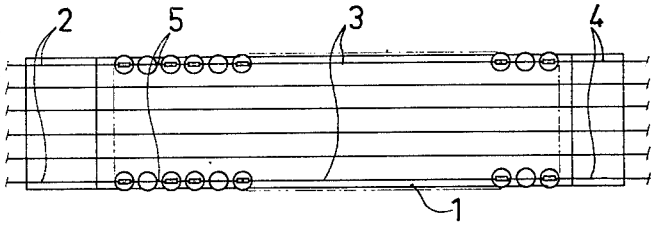
FIG. 2 is a top plan view of the arrangement of FIG. 1.
Figure 3:
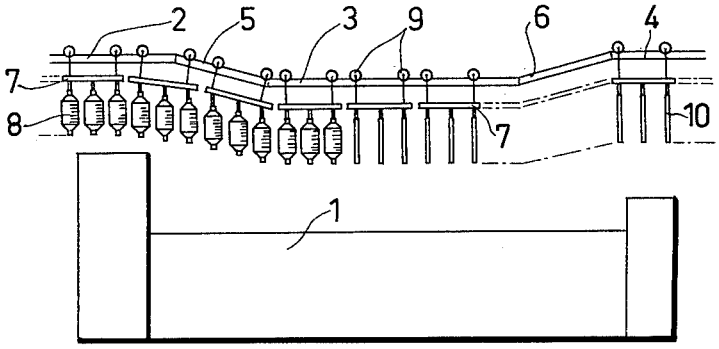
FIG. 3 is a side view of the arrangement of FIG. 1 depicting the rails above the ring spinning machine in a different position, particularly during the infeed of full bobbins and the removal of the empty bobbin tubes.

Describing now the drawings, in FIGS. 1 to 3 there has been depicted a schematically illustrated ring spinning machine 1 equipped with a bobbin creeling apparatus of the invention. To that end there will be seen that above the ring spinning machine 1 there is provided an arrangement of different rails, and specifically the input or infeed rails 2, the creel rails 3 supported by the ring spinning machine 1 by means of the supports or support means 100, and the exit or outfeed rails 4. The creel rails 3 are each provided at one respective end with an input section 5 and at the opposite end with an output section 6. As will be explained more fully hereinafter in conjunction with FIGS. 4 to 8, each input section 5 and each exit section 6 can be raised to the location of the input rails 2 and the exit rails 4 respectively, as the same has been indicated in phantom lines in FIG. 1 and in full lines in FIGS. 3, 4 and 6. The rails 2 and 4 constitute a rail arrangement leading to the ring spinning machine 1, wherein for purposes of explanation the rails 2 have been considered to constitute the infeed or input rails and the rails 4 the exit or outfeed rails.

Continuing, the system furthermore is provided with bobbin trolleys 7 designed to ride upon the rails 2, 3, 4 of the bobbin creeling apparatus. Depending upon which operational phase of the system is being considered, there are suspended either full bobbins 8 or empty bobbin tubes 10 respectively at these bobbin trolleys 7. Now in the arrangement of FIG. 1 there are shown full bobbins 8 in their working position above the associated ring spinning machine 1, while in FIG. 3 there is shown the system at the time that an exchange of the empty tubes 10 against full bobbins 8 occurs. Each of the trolleys 7 is provided with, for instance, a pair of rolls 9 so that these trolleys 7 can be moved via the input rails 2 onto the creel rails 3, or alternatively, the trolleys 7 with the empty bobbin tubes 10 can be removed from the creel rails 3 via the outfeed or exit rails 4 respectively. During such time as the trolleys are transferred from the rails 2 onto the rails 3 or from the rails 3 onto the rails 4 it is necessary that the respective input section 5 and the exit section 6 are lifted into the full-line position depicted in FIG. 3, thereby providing an operable transfer connection between the creel rails 3 and, as the case may be, the input or infeed rails 2 and the exit or outfeed rails 4 respectively. The elevational difference of the lifted input section 5, in other words the distance through which the input section 5 is raised, advantageously may correspond to the elevational difference of the exit section 6, in other words the distance through which the exit section is raised when the equipment assumes the position depicted in FIG. 3.

Figure 4:
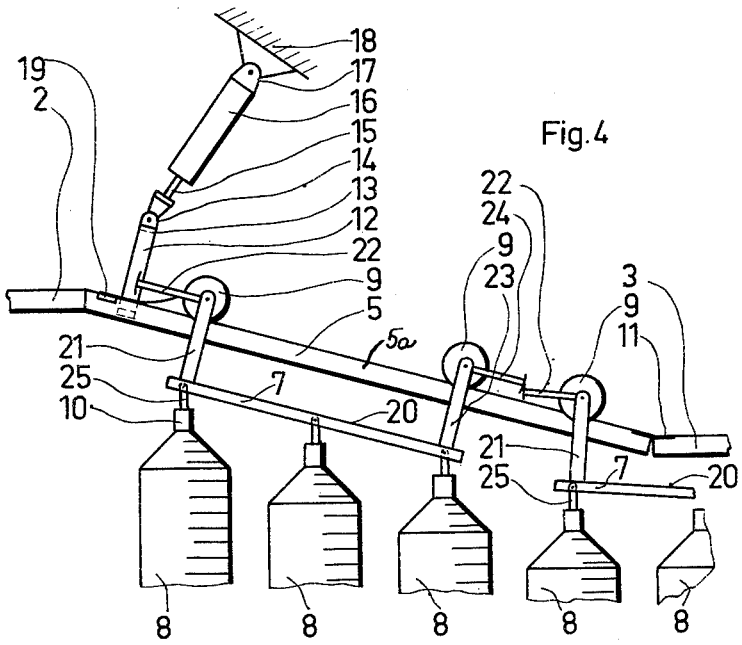
FIG. 4 is a side view depicting details of an input section of the bobbin creeling apparatus depicted in FIGS. 1 to 3, and showing the position of the rails above the ring spinning machine during the infeed of full bobbins to the ring spinning machine.
Figure 5:
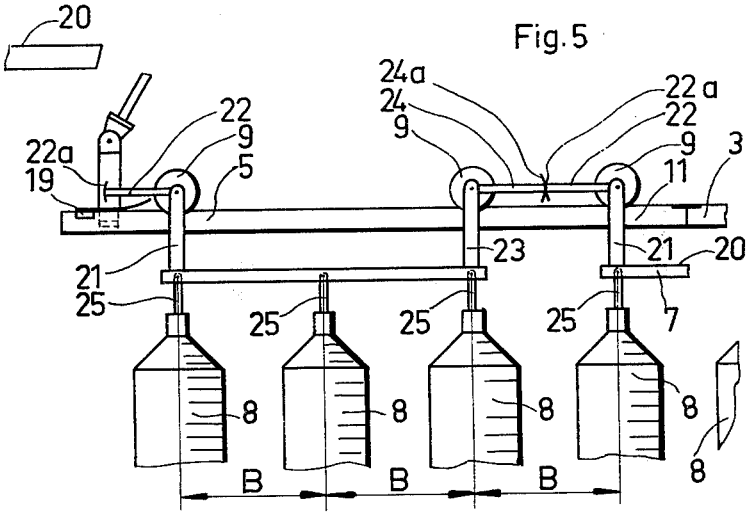
FIG. 5 is a side view showing details of the input section of the bobbin creeling apparatus employed in the arrangement of FIGS. 1 to 3 and depicting the position of the input section of the rails after the bobbins have been brought into their working position.
Figure 9:
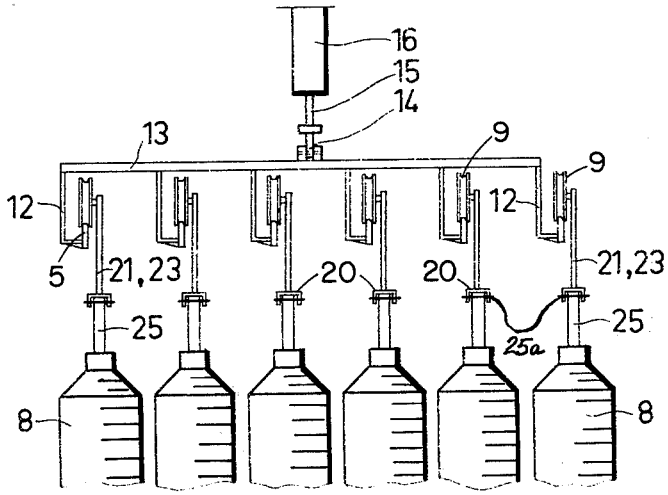
FIG. 9 is a cross-sectional view of the bobbin creeling apparatus of this invention.

Now as best seen by referring to FIG. 4, each rail **5*a* of the input section 5 — which may also be considered as individual input sections — is hingedly connected by a flexible connecting or connection member 11 with the associated creel rail 3 arranged at a lower level. At the end adjacent to the inputt rails 2 each of the input sections 5, i.e. each of the rails 5*a* thereof, is connected via a rod or bracket 12 with a transversely extending beam 13 which, in turn, is operatively connected via a hinge joint or hinge arrangement 14 with a piston 15 of a suitable pressurized cylinder arrangement 16, as best seen by referring to FIG. 9. The pressurized cylinder arrangement or pressure cylinder 16 is pivotably connected via a further hinge joint or hinge arrangement 17 with a fixed or stationary support 18. Now at the same end of the input of infeed section 5 there is advantageously provided a roll-back stop device 19 which safeguards against undesired rolling back of the trolleys 7 after they have moved onto the corresponding rail 5*a*** of the input section.

Figure 6:
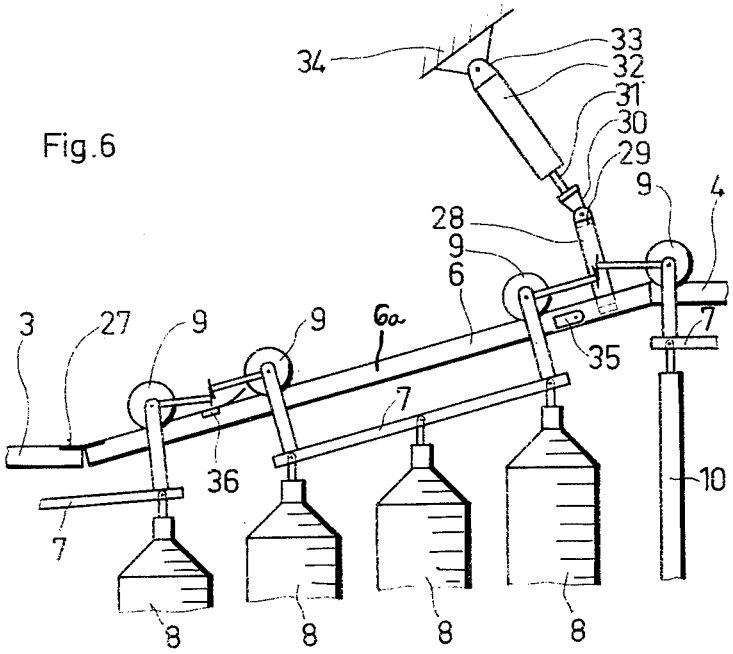
FIGS. 6 and 7 are respective side views of an exit section of the bobbin creeling apparatus employed in the arrangement of FIGS. 1 to 3, and showing the position of the rails of the exit section during removal of the empty bobbin tubes from the ring spinning machine.
Figure 7:
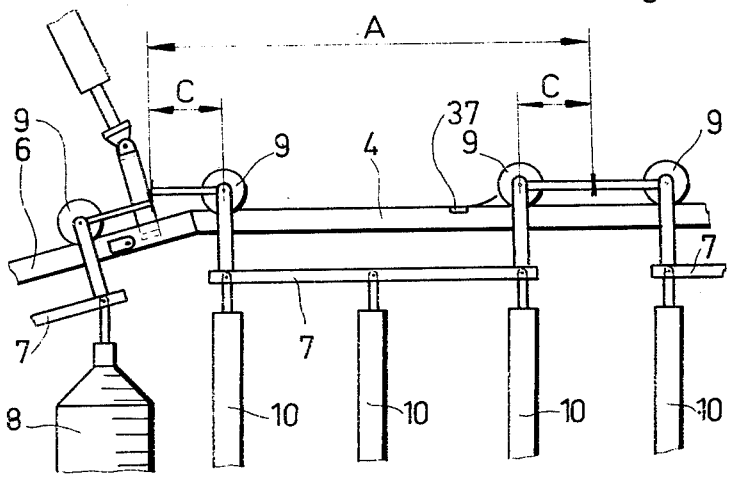
Figure 8:
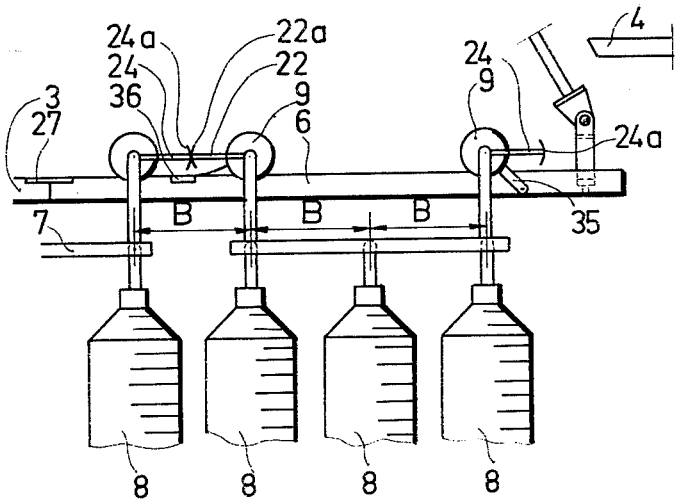
FIG. 8 is a side view, similar to the showing of FIGS. 6 and 7, depicting the position of the rails of the exit section after removal of the empty bobbin tubes and the replenishment thereof by full bobbin tubes which have been placed in their working position at the ring spinning machine.

As far as the construction of the trolleys 7 is concerned, it will be seen that in the exemplary illustrated embodiment each such trolley consists of a supporting member 20 and the branch rods or leg members 21 and 23 which are each connected to the aforesaid supporting member 20, the rolls 9 rotatably supported by the branch rods or leg members 21 and 23, a first distance bumper rod 22 connected with the branch rod 21 and provided with a bumper guard or bumper surface **22*a* (FIG. 5), and a distance bumper rod 24 connected with the other branch rod 23 and provided with a bumper guard or bumper surface 24*a*. As best seen by referring to FIG. 7, the distance A between the bumper guard 22*a* and the bumper guard 24*a* amounts to, for instance, three times the bobbin gauge B (FIGS. 5 and 8), the term "bobbin gauge" designating the distance from the lengthwise axis of one bobbin 8 to the lengthwise axis of the adjacent bobbin 8, as shown. The length C of the distance bumper rods 22 and 24 respectively is chosen such that the bobbin gauge B remains substantially at least the same for all of the bobbins 8 located in their working position, in other words, twice the value of the length C corresponds to the bobbin gauge B. As best seen by referring to FIG. 9, bobbin support pins 25 are hingedly connected or flexibly connected, as generally indicated by reference character 25*a*, with the supporting member 20 of each associated trolley 7. The tubes 10 of the bobbins 8 are suspended at the bobbin support pins 25. Just as was the case with the input section 5, the outfeed or exit section 6 — which also may be considered to constitute a number of individual exit sections — has each of the exit section rails 6a hingedly connected by a flexible connection or connecting an 27 with the associated rail of the creel rails 3 (see FIGS. 6 and 8). Also analogous to the arrangement of the input section 5, at the end adjacent to the exit or outfeed rails 4 each of the rails 6*a* of the exit section 6, as best seen by referring to FIG. 6, is connected via a rod or bracket 28 with a transversely extending beam or cross member 29 which, in turn, is again connected via a hinge joint or hinge 30 with a piston 31 of a pressurized cylinder arrangement 32 which is pivotably connected via a further hinge joint or hinge 33 with a fixed base or stationary support 34. At the same end of the exit or outfeed section 6 there is pivotably mounted for upward pivotal movement a stop latch means 35 which in its tilted-up position (FIG. 8) prevents further rolling of the rolls 9 of the trolleys 7. In close vicinity to a end of the exit section 6 and adjacent to the creel rails 3 there is provided a further roll-back stop device 36 (FIG. 8) which has an analogous function to the roll-back stop device 19, in this case preventing undesired rolling back of the trolleys 7 onto the creel rails 3 after the same has moved to the region of the exit section 6. The distance between the roll-back stop device 36 and the stop latch means 35 is chosen such that when the stop latch means 35 is tilted-up, a trolley 7 located between the roll-back stop device 36 and the stop latch means 35 is secured against both forward and backward movement, as clearly shown in FIG. 8. An additional roll-back stop device 37 is also provided on each of the exit rails 4, as best seen by referring to FIG. 7.** In view of the described functions of the roll-back stop devices and the stop latch means, it should be apparent that such components are advantageously provided for each of the individual rails so as to carry out their desired function in cooperation with the trolleys located thereon.

Figure 10:
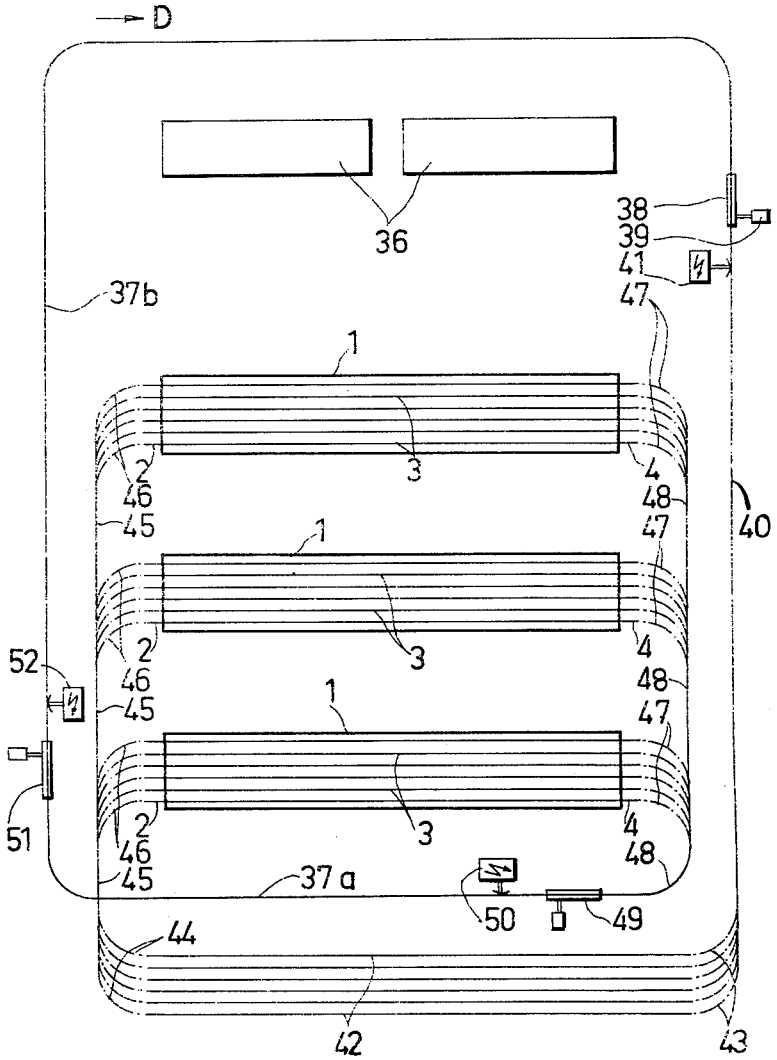
FIG. 10 is a schematic top plan view of a creeling apparatus arrangement designed according to the teachings of the invention.

Now with the foregoing discussion of the construction of the equipment in mind, the operation of such apparatus will now be considered and is as follows:

As best seen by referring to FIG. 10, at the preparatory spinning machines 36, for example roving frames, the empty tubes 10 from the trolleys 7 which have been brought back upon a return or feedback rail section **37*b* in the direction of the arrow D, are supplied with full bobbins 8. The trolleys 7 carrying the full bobbins 8 are then manually moved through a suitable lifting arrangement or elevating mechanism 38. The lifting arrangement 38, driven by a drive motor 39, transports the trolleys 7 onto a supply rail section 40 while overcoming a certain elevational difference. At the location of the supply rail section 40 the trolleys 7 roll down a slope or gradient, which it will be recalled was rendered possible due to overcoming the elevational difference by the preceding lifting arrangement 38, onto reserve rails 42 which can be connected with the supply rail or supply rail section 40 by means of rail switches 43. At the reserve rails 42 it is possible to hold in reserve at least the same number of trolleys 7 as can be taken-up by the creel rails 3 disposed above the ring spinning machine 1. Now the exchange of trolleys 7 on the creel rails 3 carrying the empty bobbins 10 against trolleys 7 carrying full bobbins 8** is undertaken in the following manner:

By means of the pressurized cylinder arrangement 16, which may be a pneumatic cylinder, the input section 5 is pivoted-up from its horizontal position, as best seen by referring to FIG. 1, to a location where it establishes an operable transfer connection with the input rails 2. The same pivoting movement is also carried out for the exit section 6 by means of the pressurized cylinder arrangement 32, likewise for instance a pneumatic cylinder, until there is established an operable transfer connection with the exit rails 4. Thereafter, the stop latch means 35 are lowered to permit rolling-off of the trolleys 7 carrying the empty tubes 10 in the direction of the exit rails 4. Then the reserve rails 42 (FIG. 10) are connected with the distribution rail 45 by means of the rail switches 44, and such distribution rail 45 in turn is connected with the input rails 2 by means of the rail switches 46. The trolleys 7 are then rolled, via the rail switches 44, onto the distribution rail 45 and via the rail switches 46 onto the input rails 2. It is possible to move the troleys 7 from the reserve rails 42 either manually or by appropriate auxiliary means (not shown). At the individual creel rails 3 the following occurs: the trolleys 7 carrying the full bobbins 8 and brought onto the input section 5 (FIG. 4), owing to their own weight and to the gradient or slope of the input section in the pivoted-up position previously established, displace the trolleys 7 carrying the empty bobbins 10 away from the creel rails 3 via the upwardly inclined exit section 6 onto the exit rails 4 (FIG. 6). The loss of momentum or thrust of the incoming trolleys 7 due to friction can be compensated by additionally manually pushing these trolleys or by designing the height differential of the exit section 6 to be smaller than that of the input section 5, wherein in FIG. 1 there is shown in exaggerated manner the height of the input rail 2 and slope of the raised input section 5 to be greater than the height of the exit rail 4 and the slope of the raised exit section 6. As the first trolley 7 carrying full bobbins 8 reaches the exit section 6, the stop latch means or device 35 is again manually tilted-up into its upright position. As already heretofore discussed, this first trolley is then maintained in this terminal position which it has reached by means of the roll-back stop device 36 and the stop latch means 35. The position of the roll-back stop device 19 at the input section 5 is selected such that the last incoming trolley 7 is prevented, on the one hand, from rolling back and, on the other hand, is arranged adjacent to the trolleys 7 which have already been moved onto the associated creel rail 3 and lined-up therewith. As soon as all of the creel rails 3 of the ring spinning machine 1 are filled with the trolleys 7 carrying the full bobbins 8, the individual input sections 5 and exit sections 6, in other words the rails 5a and 6a thereof, are pivoted back to their horizontal position by means of the pressure cylinder 16 and pressure cylinder 32 respectively. The trolleys 7 carrying the empty tubes 10 and now located at the exit rails 4 are then brought via the switches 47 onto a collecting rail 48. At the end of the collecting rail 48 these trolleys are then moved via an adjacent lifting section 49, while overcoming a certain elevational difference, onto the feedback or return rail section **37*a*. The trolleys 7 roll freely to the next lifting section 51 along the gradient or slope of the feedback or return rail section 37*a* which has been provided due to overcoming the elevational difference by means of the lifting section 49. After this lifting section 51, the trolley 7 again rolls down the slope or gradient provided at the return rail section 37*b* in the direction of the arrow D back to the spinning preparatory machines 37. After each lifting section 38, 49 and 51 there is provided a respective electrical switch 41, 50 and 52, each such switch being triggered by the trolley 7 and activating a timing relay for stopping the preceding lifting section if the subsequent rail section fills-up with trolleys 7** which have not moved further along. In this manner it is possible to prevent damage to the lifting sections.

The arrangement is, however, not limited to the exemplary embodiment depicted in FIG. 10 but can be laid out in any other suitable manner employing the described system elements. It is possible to provide further lifting or lowering sections suitably driven for overcoming height differentials, particularly if the spinning preparatory machines and the ring spinning machines are not located on the same floor. Feed control devices are then arranged preceding each such inclined section.

Some of the more notable advantages of the described apparatus are the following:

1. The trolleys carrying the full bobbins can be rolled into their working position above the ring spinning machines, thereby eliminating the heavy and cumbersome manual work of suspending full bobbins from the creel arrangement which is generally carried out by female operators.

2. The gradients or slopes provided at the input section and the height or elevational differential of the exit sections of the creel rails brings about natural filling of the creel rails with trolleys carrying full bobbins and pushing-out or off-loading the trolleys carrying empty tubes until the trolleys carrying the full bobbins are balanced-out as concerns their weight at the inclined input and exit sections.

3. The arrangement of the reserve rails affords the possibility of appropriately accommodating the differences in production between the spinning preparatory machines and the ring spinning machines and further permits an accumulation of a reserve of trolleys carrying full bobbins which is quickly available when needed.

4. By incorporating a drive into the lifting sections and owing to the resulting gradient of the subsequent rail sections, a further propulsion mechanism for the trolleys can be dispensed with.

While there is shown and described present preferred embodiments of the invention, it is to be distinctly understood that the invention is not limited thereto, but may be otherwise variously embodied and practiced within the scope of the following claims.

What is claimed is:

1. An apparatus for creeling bobbins into a working position at a ring spinning machine, comprising rail means arranged above the ring spinning machine, said rail means extending substantially parallel to the longitudinal axis of the ring spinning machine and comprising input rails, creel rails and exit rails, wherein said creel rails are arranged at a lower height than the input rails and exit rails, each of said creel rails having operatively associated therewith one of said input rails and one of said exit rails, each of said creel rails including a pivotable input section and a pivotable exit section, each of the creel rails being connected via its pivotable input section with its associated input rail and via its pivotable exit section with its associated exit rail, trolleys movable on said rail means for carrying bobbins placed thereon, means for selectively pivoting each input section from a first position into a second position connecting the associated input rail with its creel rail for transferring trolleys carrying full bobbins from such input rail to such creel rail into a bobbin working position, means for selectively pivoting each exit section from a first position into a second position for transferring trolleys with empty bobbins from the associated creel rail to the associated exit rail, each input section and its associated exit section when assuming their respective first positions disconnecting the associated creel rail from the associated input rail and exit rail to prevent transfer of trolleys from the associated input rail to the associated creel rail and from the latter to the associated exit rail in order to maintain the trolleys on the associated creel rail in said bobbin working position, a rail arrangement operatively associated with the ring spinning machine and connecting means for operatively connecting the rail means with the rail arrangement.

2. The apparatus as defined in claim 1, wherein a pair of rolls is provided for each of the trolleys, said rolls of each trolley being supported and guided by the rail means and rail arrangement.

3. The apparatus as defined in claim 1, wherein each of the trolleys is provided with bobbin tube-support pins for taking-up bobbin tubes.

4. The apparatus as defined in claim 3, further including means for movably supporting the bobbin tube-support pins at the trolleys.

5. The apparatus as defined in claim 3, further including means for flexibly supporting the bobbin tube-support pins at the trolleys.

6. The apparatus as defined in claim 1, further including a respective bumper provided for each trolley at both ends of the trolley in the longitudinal direction thereof, each bumper being provided with means defining a bumper surface.

7. The apparatus as defined in claim 6, wherein the distance, in the lengthwise direction of each trolley, from its one bumper surface to the other bumper surface substantially corresponds to the distance from the center-line of one bobbin to the center-line of the adjacent bobbin multiplied by the number of bobbins carried by each such trolley.

8. The apparatus as defined in claim 1, wherein said connecting means for connecting the rail means with the rail arrangement include switch means.

9. The apparatus as defined in claim 1, wherein the exit rails are arranged at a lower elevation than the input rails.

10. The apparatus as defined in claim 1, wherein the creel rails are arranged at a lower height than the input rails and exit rails.

11. The apparatus as defined in claim 1, wherein the input section includes means defining a roll-back stop device for impeding the rolling back of the trolleys.

12. The apparatus as defined in claim 1, wherein the exit section is provided with means defining a roll-back stop device for impeding the rolling back of the trolleys and with stop latch means acting in the direction of transport of bobbin tubes.

13. The apparatus as defined in claim 1, further including support means provided for the ring spinning machine for supporting said creel rails.

14. An apparatus for creeling bobbins into a working position at a ring spinning machine, comprising rail means arranged above the ring spinning machine, said rail means extending substantially parallel to the longitudinal axis of the ring spinning machine and comprising input rails, creel rails and exit rails, wherein said creel rails are arranged at a lower height than the input rails and exit rails, said creel rails including a pivotable input section and a pivotable exit section, the creel rails being connected via the pivotable input section with the input rails and via the pivotable exit section with the exit rails, trolleys movable on said rail means for carrying bobbins placed thereon, a rail arrangement operatively associated with the ring spinning machine and connecting means for operatively connecting the rail means with the rail arrangement, said exit section being provided with means defining a roll-back stop device for impeding the rolling back of the trolleys and with stop latch means acting in the direction of transport of bobbin tubes, said input section being provided with means defining a roll-back stop device for impeding the rolling-back of the trolleys, and wherein the roll-back stop device of the input section and the stop latch means of the exit section are arranged in such a manner that they secure the trolleys disposed therebetween against horizontal displacement and thus maintain the bobbins suspended from the trolleys in their working position at the ring spinning machine.

15. A method of creeling bobbins into a working position at a ring spinning machine by means of a transporting rail arrangement forming a closed loop for transporting trolleys carrying full bobbins from spinning preparatory machines and trolleys carrying empty bobbins back again to the spinning preparatory machines, comprising the steps of transporting trolleys onto a rail arrangement provided above the ring spinning machine, moving the trolleys carrying full bobbins via a sloped input section of the rail arrangement above the ring spinning machine as they move onto the rail arrangement above the spinning machine and owing to the overweight of the full bobbin trolleys, the trolleys carrying the empty tubes are pushed-off the rail arrangement above the ring spinning machine onto the transporting rail arrangement, thus bringing the full bobbins into their working positions at the ring spinning machine at such rail arrangement.

16. The method as defined in claim 15, further including the step of moving the trolleys carrying full bobbins onto a reserve rail section supplementing the transporting rail arrangement.

17. The method as defined in claim 16, including the step of using a reserve rail section which can accommodate at least the same number of trolleys as the rail arrangement above the ring spinning machine.

18. The method as defined in claim 16, including the step of moving the trolleys from the reserve rail section onto the rail arrangement above the ring spinning machine.

19. The method as defined in claim 15, further including the step of moving the trolleys carrying empty tubes from the rail arrangement above the ring spinning machines onto the transporting rail arrangement during such time as the trolleys carrying full bobbins are moved onto the rail arrangement above the ring spinning machine.

20. The method as defined in claim 15, further including the step of employing mechanical means for effectuating movement of the trolleys on the transporting rail arrangement at least over part of their path of movement.

21. The method as defined in claim 20, wherein movement by the mechanical means is effected at lifting sections within which the trolleys are moved to a given height differential such that the trolleys freely roll on a subsequent gradient of an adjacent section of the transporting rail arrangement.

22. The method as defined in claim 15, including the step of manually effecting along a part of their path of movement the movement of the trolleys on the transporting rails.

23. The method as defined in claim 15, including the step of employing mechanical means and also manually effectuating movement of the trolleys.

24. The method as defined in claim 15, wherein the trolleys carrying empty tubes are moved from the rail arrangement above the ring spinning machine over a lifting exit section provided at the end of such rail arrangement located above the ring spinning machine.

25. The method as defined in claim 24, including the step of pivoting the sloped input section and the lifting exit section into a substantially horizontal position after the trolleys with the full bobbins are located on the rail arrangement above the ring spinning machine.

* * * * *